US005121735A

United States Patent [19]

Hancock

[11] Patent Number: 5,121,735

[45] Date of Patent: Jun. 16, 1992

[54] BALL PITCHING MACHINE

[76] Inventor: Kenneth H. Hancock, 924 Manchester Rd., Salina, Kans. 67401

[21] Appl. No.: 525,678

[22] Filed: May 21, 1990

[51] Int. Cl.[5] ..... F41B 3/04

[52] U.S. Cl. ..... 124/7; 124/41.1; 273/26 D

[58] Field of Search ..... 124/7, 6, 48, 49, 50, 124/81, 1, 80, 41.1; 273/26 D

[56] References Cited

U.S. PATENT DOCUMENTS

| | | | |
|---|---|---|---|
| 292,043 | 1/1884 | Parmerlee | 124/7 |
| 2,696,204 | 12/1954 | Gilgoff | 124/7 |
| 2,815,743 | 12/1957 | Brunderman . | |
| 3,136,308 | 6/1964 | Giovagnoli | 124/7 |
| 3,207,147 | 9/1965 | Giovagnoli | 124/7 X |
| 3,406,674 | 10/1968 | Zone | 124/7 |
| 3,470,859 | 10/1969 | Ponza | 124/7 |
| 3,659,576 | 5/1972 | Eade et al. | 124/32 X |
| 3,760,787 | 9/1973 | Kahelin . | |
| 3,777,733 | 12/1973 | Mitchell . | |
| 4,082,076 | 4/1978 | Perry | 124/7 |
| 4,175,535 | 11/1979 | Diem | 124/81 X |
| 4,209,003 | 6/1980 | Sainsbury . | |
| 4,209,004 | 6/1980 | Kennedy | 124/7 |
| 4,262,648 | 4/1981 | Wegener et al. . | |
| 4,269,162 | 5/1981 | Abraham et al. | 124/7 |
| 4,458,656 | 7/1984 | Giovagnoli | 124/7 |
| 4,471,746 | 9/1984 | Ando . | |
| 4,501,257 | 2/1985 | Kholin . | |
| 4,524,749 | 6/1985 | Giovagnoli | 124/7 |
| 4,611,571 | 9/1986 | Tressler et al. | 124/7 |
| 4,615,325 | 10/1986 | Yamamura et al. . | |

FOREIGN PATENT DOCUMENTS

| | | | |
|---|---|---|---|
| 0439647 | 7/1935 | United Kingdom | 124/7 |

*Primary Examiner*—Randolph A. Reese
*Assistant Examiner*—John A. Ricci
*Attorney, Agent, or Firm*—Kokjer, Kircher, Bowman & Johnson

[57] ABSTRACT

A pitching machine for simulating the high speed, underhand delivered pitch used in fast pitch softball. An electric motor drives an arm on a 360° vertical path of travel. A lost motion coupling between the motor and the arm permits a spring drive during a portion of each arm revolution. The arm is connected to a torsion spring so that energy stored in the spring drives the arm during a portion of each revolution at a high rate of speed to propel the ball from the pitching unit by centrifugal motion as the arm approaches the bottom of its path of travel. A shroud in the form of a cup-shaped cage open at one end cooperates with a curved member to hold the ball until the release point is reached. An optional spring biased, toothed, pivoted lever adjacent the shroud discharge opening frictionally engages the ball to cause a trajectory altering spin to the ball as it is propelled from the unit. A plunger operated ball supply ramp delivers the balls, one at a time, to a station for automatic pickup by the arm during each machine cycle.

21 Claims, 4 Drawing Sheets

BALL PITCHING MACHINE

This invention pertains to throwing apparatus and more particularly, to a machine for simulating the pitch utilized in the sport of "fast pitch" softball. Ball pitching machines are well known and are widely used for practice in connection with a variety of sports such as baseball, tennis or the like. Machines which simulate the speed and trajectory of balls encountered under actual conditions can be very effective tools for enhancing a player's efficiency.

A variety of baseball pitching machines are available. Many of these machines are able to simulate rather accurately the speeds and trajectories of baseballs thrown by the conventional overhand pitching delivery permitted by the rules governing baseball. However, the pitching motion permitted in the game of softball is restricted to an underhand delivery. Consequently, baseball pitching machines are relatively ineffective as tools for practicing softball.

Several machines have been suggested for simulating the underhand pitching of softball. Insofar as applicant is aware, all of the machines of this type have been intended for simulating the pitching used in the game commonly referred to as "slow pitch" softball. The ball is delivered to the batter by the pitcher in a high lazy arc in "slow pitch" softball. In contrast, the game of fast pitch softball closely resembles the game of baseball. However, the ball must be delivered from an underhand motion. Good pitchers in fast pitch softball are able to deliver the ball at speeds approaching 100 miles per hour, even with the underhand motion. Machines capable of simulating the pitch for slow pitch softball are wholly inappropriate for practicing the fast pitch game.

Accordingly, it is a primary object of the present invention to provide a ball propelling machine capable of simulating the pitch of a fast pitch softball pitcher.

Another object of the present invention is to provide a machine of this type wherein the pitching hand holds and delivers the ball in close simulation to the manner used by a human pitcher to provide better training for actual game conditions.

A further object of the present invention is to provide a shroud for effectively holding a ball through the downward movement of the pitching arm to a release point at or near the bottom of the path of movement to simulate the underhand delivery.

Yet another object of the present invention is to provide apparatus for automatically and reliably delivering a single ball from a supply of balls to the throwing unit during each cycle of the machine.

Still another object of this invention is to provide means which may be optionally utilized for varying the trajectory of balls pitched by the machine to further simulate the manner in which balls are pitched in actual game conditions.

These and other important aims and objectives of the present invention will be further explained or will be apparent from the following descriptions, explanation and claims.

Figure 2:
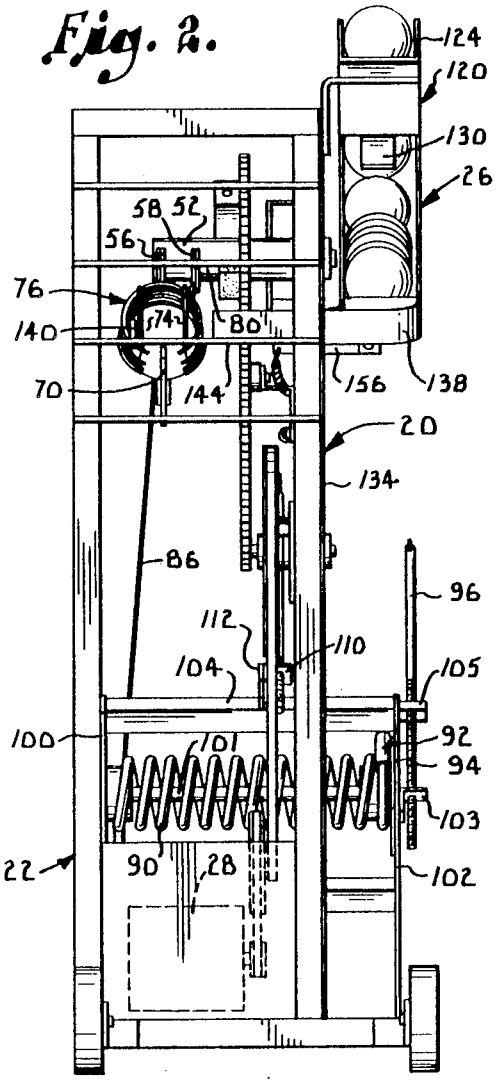
FIG. 2 is a front elevational view thereof.

A machine embodying the principles of this invention is broadly designated in the drawings by the reference numeral 20 and includes a frame 22, a throwing unit 24 mounted on the frame and apparatus 26 also mounted on the frame for supplying balls to the throwing unit. As will be explained hereinafter, apparatus 26 automatically furnishes one ball from a ball supply to the throwing unit during each cycle of the latter.

Throwing unit 24 is driven in part by an electric motor 28 mounted on frame 26 near the bottom of the latter. The motor drives a compound pulley 30 through a belt 32. A relatively large pulley 34 is driven by a belt 36 upwardly coupled with the relatively small drive of compound pulley 30. A sprocket 38 secured to pulley 34 drives a large sprocket 40 by means of a drive chain 42. The latter is kept tight by an idler sprocket 44 mounted on a pivoted arm 46 biased by a spring 48 to urge sprocket 44 in a direction to tighten the drive chain. Sprocket 40 is mounted on a shaft 50 which is journaled to the frame 22 by suitable bearings as will be readily understood.

A cylindrical hub 52 is journaled on shaft 50 by roller bearings 54. Lugs 56 and 58 rigidly attached as by welding or the like project radially outwardly from the outer surface of hub 52 and provide means for attaching an elongated, rigid arm 60 to the hub.

Figure 1:
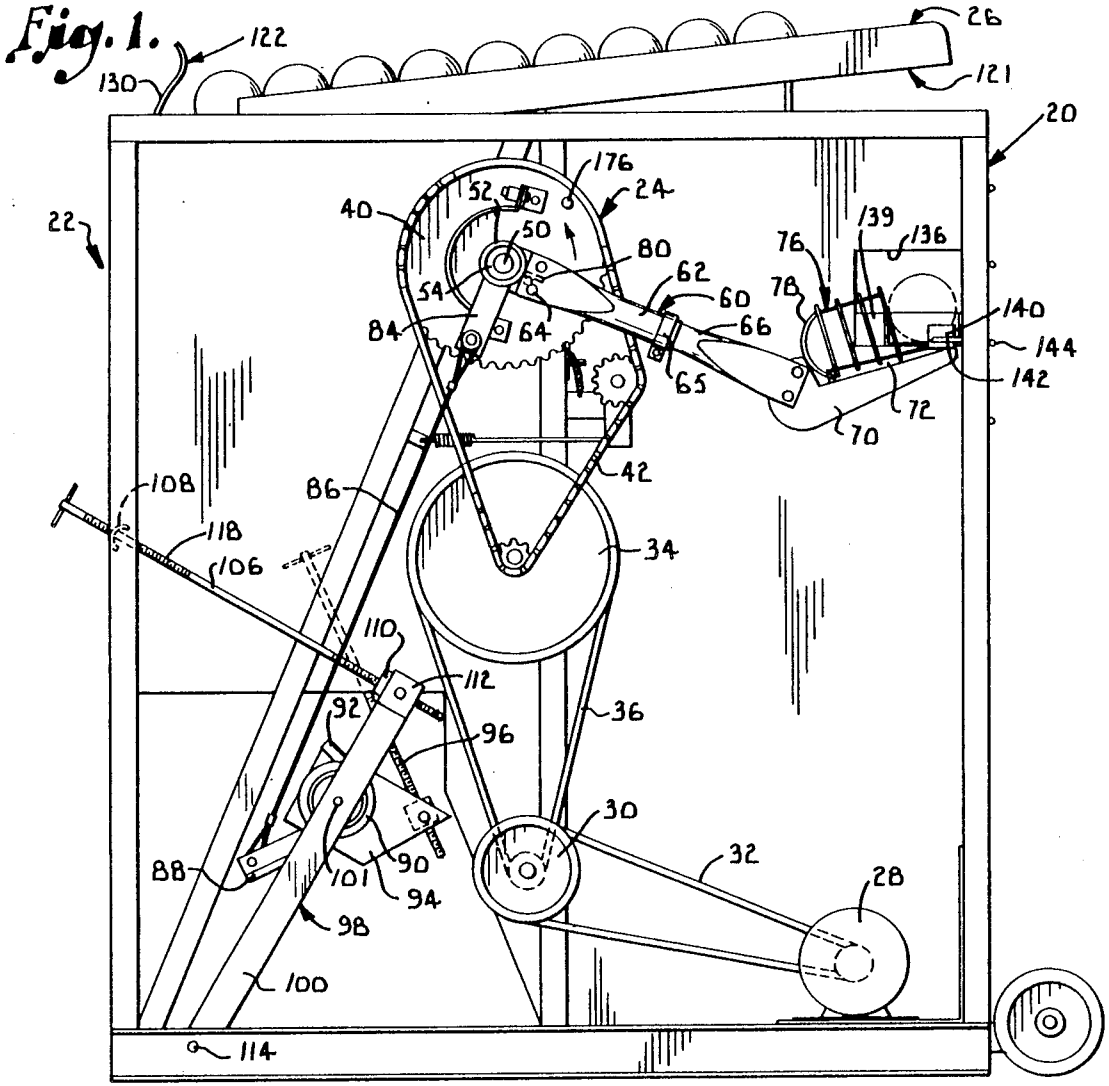
FIG. 1 is a right side elevational view of a machine embodying the principles of this invention.
Figure 4:
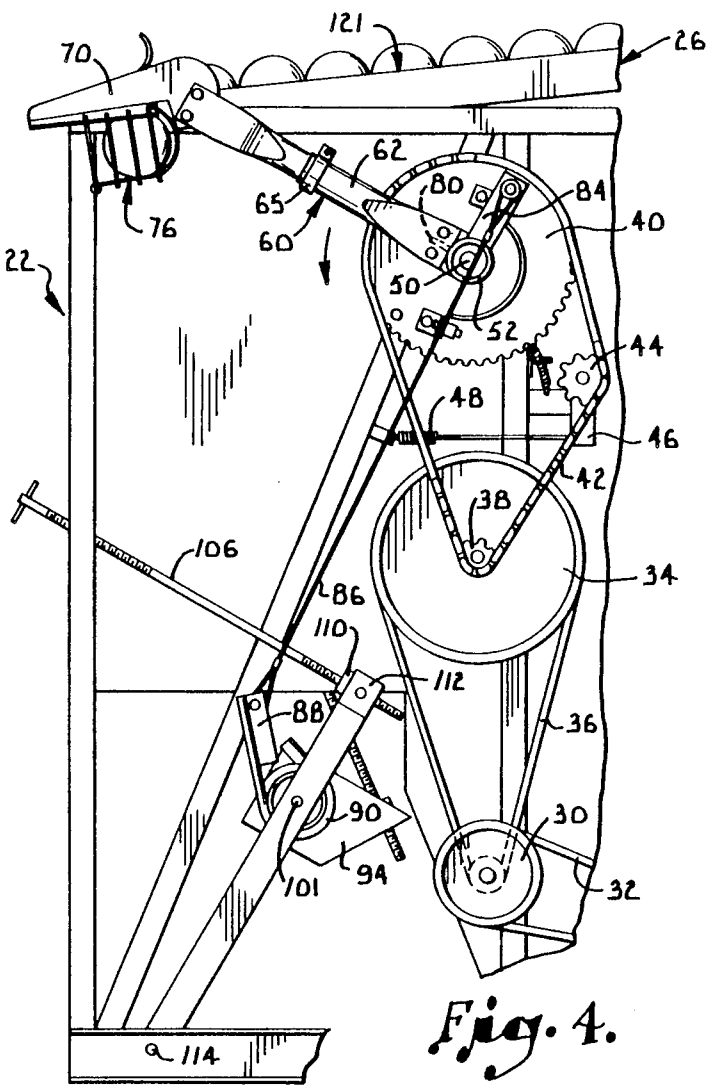
FIG. 4 is a fragmentary view similar to FIG. 1 but showing the relative positions of components at a different position of the pitching arm.
Figure 13:
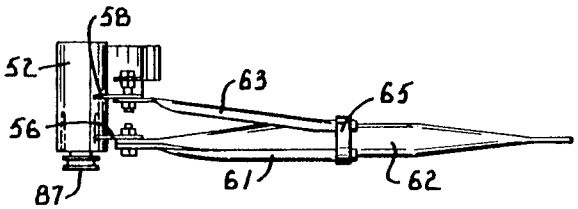
FIG. 13 is a top plan view of a section of the throwing arm and hub assembly.

As best seen in FIGS. 1, 4, and 13, a first section 62 of arm 60 is of transversely circular, tubular construction bifurcated and flattened at the end of the section proximal hub 52 for attachment by bolts 64 to lug 56 of the hub. An elongated, rigid, lightweight member 61 is also bolted at one end to lug 56. Member 61 extends in general parallelism with arm section 62 as shown in FIG. 13. A similar member 63 is bolted to lug 58 and extends at an angle to engage arm section 62 intermediate the ends of the latter as shown in FIG. 13. An annular clamp 65 circumscribes the outermost ends of members 61 and 63 as well as section 62 to secure the members to the arm to provide reinforcement to the arm so that the latter may accommodate the substantial forces imparted to the arm without departing from the relatively light weight tubular construction for arm section 62. This minimizes the inertia of the arm during operation of the machine compared to the inertia which would be involved if more massive construction were to be utilized.

Figure 10:
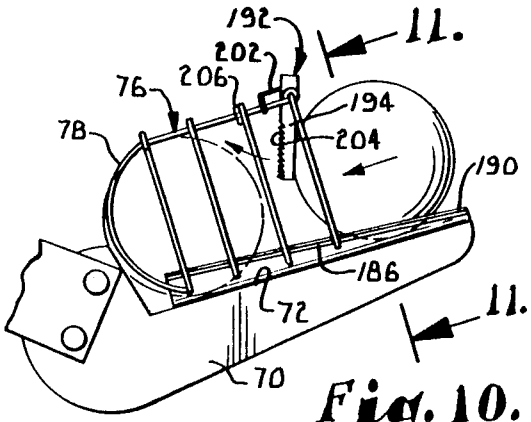
FIG. 10 is an enlarged, fragmentary right side elevational view of the pitching unit at the loading station with a ball entering the unit.

The outer bifurcated, flattened end of arm section 62 is bolted to an elongated, rigid, generally L-shaped element 70 of substantially flat sheet material cut in the shape shown best in FIG. 10 of the drawing. Element 70 has an elongated edge 72 disposed to lie slightly outside the plane of the side wall of an elongated, cylindrical cavity 74 (FIG. 2) defined by a cup-shaped ball retaining structure in the form of a cage 76 formed of a plurality of spaced apart, mutually interconnected wire members 78. Cage 76 and a curved member 186 supported on edge 72 of element 70 conjointly form a shroud defining an internal cavity having an open end directed away from the axis of rotation of arm 60 about shaft 50. The sides and opposite end of the shroud are enclosed by the wire members and member 186 to hold the ball against ingress or egress to or from the shroud except through the outermost open end of the latter.

Figure 6:
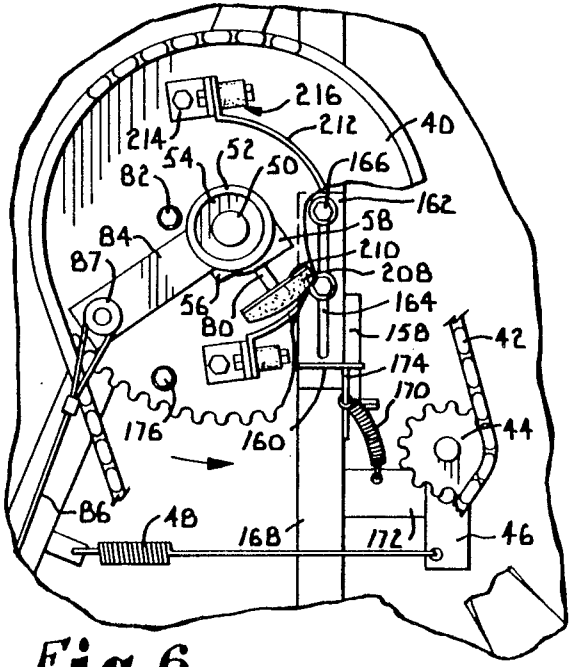
FIG. 6 is an enlarged, fragmentary view similar to FIG. 4, parts being broken away to reveal details of construction.

A rigid rectangular flange 80 (FIGS. 1, 2 and 6) has one edge welded to the outer surface of hub 52 with the flange projecting radially outwardly from the hub and extending between the innermost arm attaching lug 58 and the proximal surface of sprocket 40. A pin 82 shown best in FIG. 6 is carried by sprocket 40 and projects from the flat surface of the sprocket in disposition to engage flange 80 carried by hub 52 to drive the hub in a circular path of travel about the axis of shaft 50 as the sprocket is rotated by drive chain 42.

An elongated, rigid arm 84 is welded to the outer surface of hub 52 and projects radially from the latter substantially normal to the direction of projection of lugs 56 and 58 (and arm 62) from the hub. One end of a flexible wire rope cable 86 is pivotally attached to arm 84 by a roller 87 carried by arm 84 and the other end of the cable is attached to a projecting end 88 of a torsion spring 90 mounted to frame 22 as best shown in FIG. 2 of the drawing. The other end of spring 90 is telescoped in a sleeve 92 mounted on a plate 94 which is pivotally mounted to the frame in a manner that the force stored in the spring may be adjusted by manually rotating a threaded adjusting rod 96.

Plate 94 is pivotally mounted on a subframe 98 comprising a pair of transversely spaced apart, substantially identical elongated, rigid bars 100 and 102 pivotally connected at their lowermost ends to frame 22 and rigidly interconnected at the uppermost ends of the bars by a transversely extending angle member 104 (FIG. 2). An elongated, transversely semi-circular, rigid ear 105 is welded proximal the upper end of bar 102 to project outwardly in generally longitudinal extension from angle member 104. Ear 105 is provided with a hole extending through the ear and of a dimension to loosely receive rod 96 therethrough. An L-shaped bracket 103 is pivotally attached to plate 94 in spaced apart relationship from the axis of pivoting movement of plate 94 about a transversely extending rod 101 disposed axially of spring 90 as shown best in FIG. 2. Bracket 103 has an internally threaded hole in its outwardly projecting leg which threadably receives the threaded portion of rod 96 as shown in the drawing. Thus, rod 96 can be manually adjusted to pivot plate 94 about rod 101 to adjust the tension in torsion spring 90 as desired. Lock nuts 99 threadably installed on rod 96 above and below ear 105 serve to releasably lock the plate in the position of adjustment of the tension in spring 90 which is desired.

The pivoted position of subframe 98 with respect to frame 22 is adjustable by means of a manually operable adjusting rod 106 which extends through a hole in a transversely circular, elongated rigid ear 108 (FIG. 1) welded to one of the upright members of frame 22 at the rear of machine 20. The lowermost threaded portion of rod 106 is threadably received in the threaded opening through the laterally projecting leg of an L-shaped bracket 110 which is pivotally secured to an upright lug 112 rigidly secured to angle member 104 as shown best in FIGS. 1 and 2 of the drawing. It will be readily understood that subframe 98 may be pivoted about the points 114 and 116 of attachment of the bars 100 and 102 respectively to frame 22 by manually manipulating rod 106. Preferably locknuts (not shown) are provided on either side of ear 108 on the threaded rod portion 118 near the upper end of rod 106.

Figure 3:
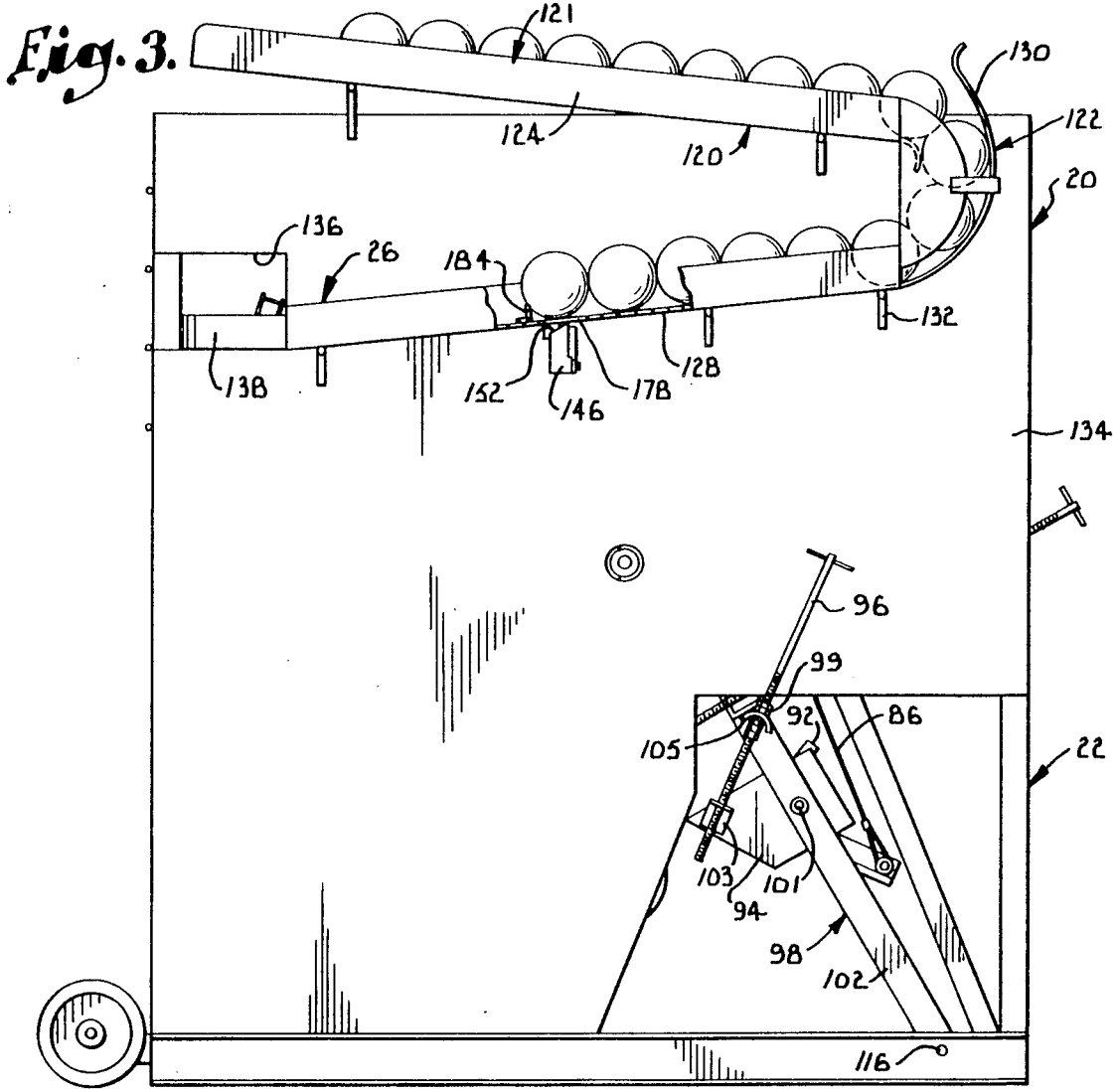
FIG. 3 is a left side elevational view thereof, parts being broken away and shown in cross-section to reveal details of construction.

Ball feeding apparatus 26 (FIGS. 1, 2, 3, 8 and 9) includes a hopper in the form of an elongated ramp 120 comprising a first ramp section 121 (FIGS. 1, 4 and 5) beginning near the front of machine 20 and extending downwardly toward the rear of the machine to a curved section 122 and thence downwardly and forwardly toward the front of the machine as illustrated best in FIG. 3 of the drawing. The ramp has a pair of side walls 124 and 126 spaced apart laterally slightly greater than the diameter of the balls to be pitched by the machine so that the balls in the ramp are restricted to a single file relationship as they gravitate along the downwardly extending ramp floor 128. An elongated, curved guide member 130 at the curved ramp section 122 serves to guide the balls from the uppermost stretch of the ramp to the lower stretch as shown. Ramp 120 is, of course, rigidly secured to the machine by a plurality of brackets 132 carried by a cover plate 134 mounted on frame 22.

Figure 5:
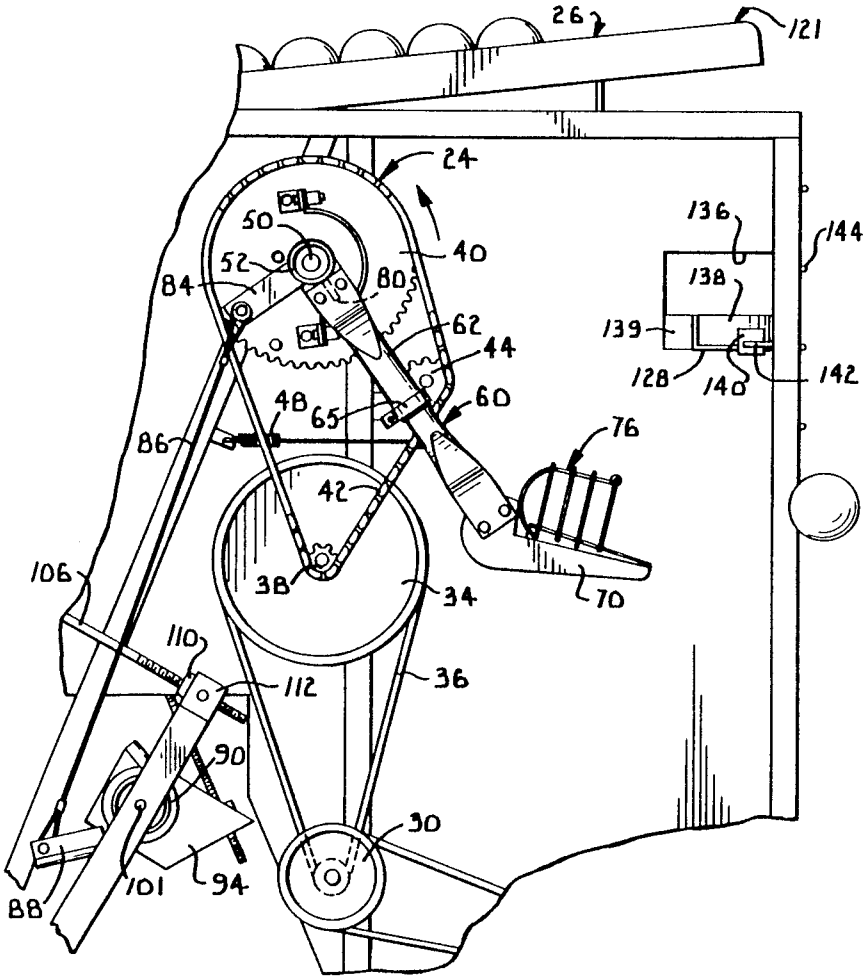
FIG. 5 is a view similar to FIG. 4 but illustrating yet another position of the pitching arm.

Cover plate 134 has an opening 136 proximal the lower end of ramp 120 and a curved guide plate 138 extends from the terminal end of side wall 124 to a ball pickup station adjacent the "at rest" position for throwing arm 60 which is illustrated in FIGS. 1 and 2 of the drawing. The ramp floor 128 extends through opening 136 to support the balls as they are guided to the pickup station by a pair of curved, spaced apart plates 138 and 139 (FIG. 5). A deflector pad 140 is secured to a rod 142 which is, in turn, secured in rearwardly projecting relationship from a transverse rod 144 (FIG. 2) carried by frame 22 at the front of the machine. Rod 144 is one of a plurality of similar rods which are secured to the frame members and extend in transverse parallelism across the machine as shown best in FIGS. 1 and 2 of the drawing. Deflector pad 140 is positioned in spaced apart relationship from the outlet end of the ball supply ramp to ensure that balls emanating from the ramp outlet gravitate onto the throwing element 70 as will be explained hereinafter.

Means for automatically presenting a single ball from a supply of balls in the hopper during each cycle of operation of the machine includes a plunger in the form of an elongated, rigid plate member 146. Member 146 is shaped as shown best in FIG. 9 of the drawing with a rearwardly facing edge 148 terminating at a higher elevation than the forwardly facing edge 150 thereof to present a forwardly and downwardly directed top edge 152 for the plunger. The member is provided with an integral, laterally projecting flange 154 which is pivotally connected to an elongated, rigid arm 156 which projects through a slot 158 through cover plate 134. The end of arm 156 proximal sprocket 40 is rigidly connected by welding or the like to the generally horizontally extending, rigid plate 160 which is welded in outwardly projecting relationship to the outer surface of an elongated, rigid slide plate 162 having an elongated, longitudinally extending slot 164 through the plate as shown in FIG. 6. A pair of vertically spaced apart bolts 166 mount plate 162 to a proximal frame member 168 for vertical reciprocating movement as illustrated by the respective positions shown in FIG. 6 and FIG. 7 of the drawing. A coil spring 170 is secured to a bracket 172 fastened to frame member 68 and the other end of the spring is fastened to a bracket 174 secured to plate 160 and slide 162 in a manner that spring 170 exerts a biasing force on the slide to bias the latter downwardly. Plunger 146 carried by arm 156 moves up and down with the slide 162 as will be apparent.

Figure 8:
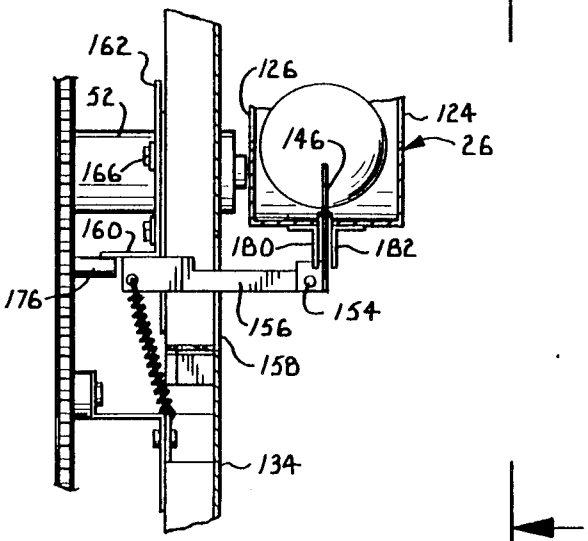
FIG. 8 is a fragmentary, detailed cross-sectional view taken along line 8—8 of FIG. 7.

A pin 176 carried by sprocket 40 in radially outwardly spaced relationship from pin 82 projects inwardly of sprocket 40 as shown clearly in FIG. 8 of the drawing. Pin 176 is positioned so that it is carried by sprocket 40 into disposition to lift slide 162 and plunger 146 to their uppermost positions during each revolution of sprocket 40. As is apparent from FIG. 7 of the drawing, when sprocket 40 has rotated to move pin 176 beyond the end of plate 160, the plate is released from the pin and the plate is reciprocated downwardly by the bias of spring 170.

Figure 9:
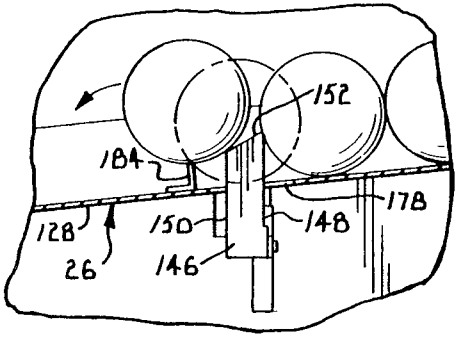
FIG. 9 is a fragmentary view taken along line 9—9 of FIG. 8, a side of the ramp being removed to show the positions of the components.

Plunger 146 is disposed for vertical movement through a slot 178 in the floor 128 of the ball supply ramp 120. The plunger is guided for vertical reciprocating movement by the spaced apart flanges of a pair of angle members 180 and 182 which are secured to the bottom surface of ramp floor 128. Slot 178 is strategically located upstream along the ramp from a barrier 184 secured to the upper surface of ramp floor 128 and projecting vertically upwardly therefrom as shown in FIGS. 3 and 9 of the drawing. Barrier 184 extends vertically above the floor of the ramp a sufficient distance to stop further gravitation down the ramp of the leading ball of the supply of balls which are arranged in single file fashion in the ball supply hopper. Plunger 146 is positioned immediately below a ball held by barrier 184 when the plunger is in its lowermost position. However, when the plunger is lifted by pin 176, the downwardly and forwardly angled edge 152 of the plunger cams the leading ball upwardly and forwardly over the barrier as illustrated generally in FIG. 9 of the drawing. The rear edge 148 of plunger 146 serves temporarily to hold back the next adjacent ball until the leading ball clears the barrier whereupon the plunger is returned by spring 170 to its lowered position and the next ball is released by the plunger to gravitate to barrier 184 where further gravitation of the ball is stopped by the barrier. The single ball which is projected over the barrier by the plunger gravitates on down the ramp and through opening 136 where it is dropped onto element 70 of the pitching arm.

It has been found desirable to provide a transversely curved member 186 on rigid element 70 at the outer end of the throwing arm for supporting a ball during the throwing motion by the machine. Member 186 is widest at the end thereof nearest hub 52 and the side edges of the member taper inwardly as the outermost end of the member is approached. The curved member 186 and rigid element 70 conjointly comprise a "hand" which propels the ball from the machine. It is desirable that the curved upper surface 188 of member 86 be as smooth as possible to permit a relatively smooth delivery of the ball from the machine. To this end, it has been found desirable to provide a pad 190 of Teflon or similar low friction material securely attached in covering relationship over the upper surface of member 186.

Figure 11:
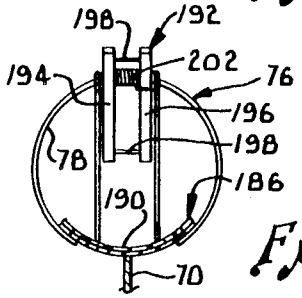
FIG. 11 is a detailed cross-sectional view taken along line 11—11 of FIG. 10.
Figure 12:
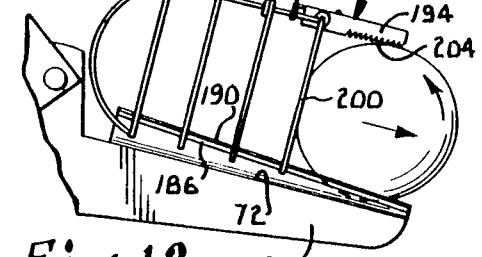
FIG. 12 is a view similar to FIG. 10 but showing the unit at the ball exiting position.

FIGS. 10 through 12 of the drawing show a trajectory altering apparatus 192 which may, if desired, be affixed to shroud 76 to effect an upward spin on the ball as it leaves the machine. Apparatus 192 comprises a pair of substantially identical, rigid, elongated finger elements 194 and 196 which are secured together in longitudinally extending parallelism by a pair of transversely extending, rigid rods 198. The elements 194 and 196 are pivotally mounted to the outermost member 200 of shroud 76 and are biased in a clockwise direction as viewed in FIGS. 10 and 12 by a spring 202 engaging the elements and the shroud respectively. The outer lower edge of each element is roughened by the provision of a plurality of spaced apart teeth 204 as illustrated. When a ball is deposited on member 186, the position of the hand element 70 is such that the ball gravitates to the closed end of shroud 76. The configuration of spring 202 is such that the ball is free to rotate elements 194 and 196 freely in the clockwise direction so that the ball can move to the closed end of the shroud. However, once the ball passes by the elements 194 and 196, egress of the ball from the shroud swings the elements in a counterclockwise direction as viewed in FIGS. 10 and 11 with the bias of spring 202 exerting a slight downward force on the elements so that teeth 204 frictionally engage the outer surface of the ball. This frictional engagement at the top of the ball imparts an upwardly directed rotation or spin on the pitched ball to provide an upwardly curved trajectory for the ball.

Should no upwardly curved trajectory be desired, the members 194 and 196 can be manually rotated clockwise and engaged under a transversely extending wire slide 206 which is slidably mounted on an adjacent pair of longitudinally extending shroud wires as shown in FIGS. 10 and 11. The bias of spring 202 holds the roughened finger elements in a disposition extending generally parallel to the side wall of the shroud where the elements do not engage the ball to affect the trajectory.

In operation, a quantity of balls are loaded in the supply hopper and motor 28 is energized. The motor turns the drive belts and chains as previously described to effect the turning of sprocket 40 in the direction o the arrow in FIG. 1 of the drawing. Throwing arm 60 is held in the position shown in this figure by the force of spring 90 acting on cable 86. Arm 60 is, of course, freely mounted on shaft 50 so that the rotation of sprocket 40 does not turn the arm until the sprocket brings pin 64 into engagement with plate 80 mounted on hub 52. As soon as pin 64 engages plate 80, arm 60 is carried by the pin with the sprocket upwardly and rearwardly against the bias of spring 90. This winds the torsion spring to store energy in the spring.

When pin 64 has moved the arm generally to the position shown in FIG. 4 of the drawing, slight further rotation of sprocket 40 by motor 28 brings the pin and arm to an "over center" condition where cable 86 pulls the arm downwardly and forwardly with the force of stored energy exerted by spring 90. Arm 60 is drivingly connected with the sprocket 40 by a "lost motion" connection wherein the arm 60 is free of sprocket 40 once the over center condition is reached and arm 60 is accelerated by the spring rapidly until crank 84 returns to the initial position as shown in FIG. 1. Thus, arm 60 is whipped by the spring from the over center position to the position with arm 84 generally aligned between shaft 50 and the point of attachment of cable 86 to spring 90.

During the rapid rotation of ar 60 before it reaches the position with arm 84 aligned between the shaft and the cable attachment point, a ball in the shroud is expelled therefrom as a result of the effects of centrifugal force on the ball. Thereafter, further rotation of the arm is resisted by the force of spring 90. This decelerates the arm rapidly when the arm is generally in the lowermost portion of its vertically extending circular path of travel. The ball is ejected from the shroud by centrifugal force as the arm moves through an "underhanded" pitching motion generally similar to the underhand pitching motion used by pitchers in fast pitch softball.

The abrupt deceleration of the arm in roughly the 6:00 o'clock position results in some oscillation of the arm after the forward swing of the arm is stopped. It has been found desirable to provide a pad 208 of relatively yieldable, frictionable material such as rubber or the like affixed to a backing plate 210 welded to the outer edge of the arm drive plate or flange 80. Pad 208 is preferably provided with a curved outer surface which engages the inner most surface of a U-shaped, elongated rigid band 212 mounted to the proximal surface of sprocket 40 by brackets 214 and shock absorbing bolts 216. The frictional engagement of pad 208 against the proximal surface of band 212 serves to attenuate the oscillating forces resulting from the abrupt deceleration of the arm and minimize oscillation of the arm. The pad and the shock absorbing bolts absorb a substantial part of the energy which would otherwise oscillate the arm.

Figure 7:
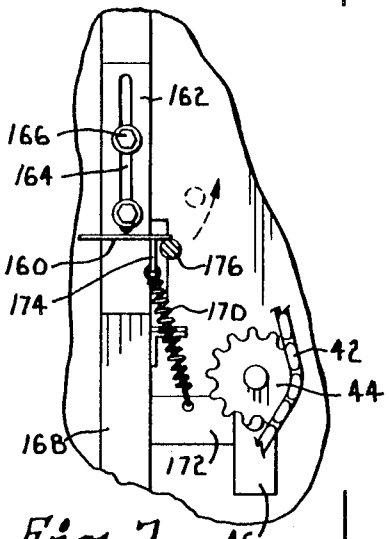
FIG. 7 is a fragmentary view similar to FIG. 6 but showing the ball loading mechanism in operated condition.

Pin 176 is carried by sprocket 40 when the latter is rotated. The pin engages side 62 and lifts plunger 146 as shown in FIGS. 7 and 8 of the drawing. This lifts the leading one of the balls in the supply hopper over barrier 184 for gravitation to the outlet opening of the ramp and onto the throwing hand. The ball emerges through opening 136 in the cover plate and onto member 186 where it is received within the cavity defined by shroud 76. The remaining balls in the hopper are retained by barrier 184 engaging the leading one of the remaining balls until the succeeding cycle of operation.

Sprocket 40 is rotated continually by motor 28 during operation of the machine. The frictional engagement between pad 208 and band 212 is insufficient t o overcome the holding force exerted by spring 90 to retain the throwing arm in the loading position shown in FIG. 1 of the drawing. However, when sprocket 40 has rotated sufficiently to again bring pin 64 into engagement with flange 80, the arm is driven as previously explained to the over center position followed by the whipping action to propel the ball forwardly from the machine. The lost motion connection wherein motor 28 is only drivingly connected to arm 60 from the time pin 64 moves flange 80 to the over center position permits the arm to be driven at two greatly different speeds by two different prime movers. Motor 28 drives the arm at a relatively slow speed and cable 86 and spring 90 drive the arm at a much greater speed. The shroud 76 retains the ball throughout the downwardly directed accelerating movement of the arm by the spring and cable until the arm is then rapidly decelerated at or near the 6:00 o'clock position also by the spring and cable. The shape of member 186 and the shroud serve to generally simulate the holding of a ball by a human pitcher so that the entire pitching motion closely simulates for a batter the pitching which would be effected by a human pitcher pursuant to fast pitch softball rules.

If it is desired that the machine impart an altered trajectory to the ball, apparatus 192 may be used for that purpose.

It will be readily understood that the balls from the supply hopper are automatically loaded, one per cycle of the machine, into the shroud and are then pitched by the machine. The placement of pin 176 relative to pin 64 circumferentially on sprocket 40 is such that a ball is ejected from the supply at the appropriate time to permit gravitation to the loading station prior to the movement of the arm from the loading station by pin 64.

The force exerted by spring 90 and, hence, the speed at which the balls are propelled from the machine can be readily adjusted by the manual rotation of rod 96 to adjust the tension in torsion spring 90. Further, the height of the trajectory of the ball can be adjusted by manual rotation of rod 106. This shifts the angled position of subframe 98, thereby adjusting the point in the rotation of sprocket 40 at which arm 60 reaches the over center condition. This, in turn, alters the height at which the balls are propelled from the machine.

In the preferred embodiment, suitable safety shields are installed on frame 22 to shield the working components of the machine and to eliminate the possibility of inadvertent injury. A cover plate (not shown) of preferably expanded metal is swingably attached to frame 22 on the side of the machine opposite cover plate 134. This swingable cover is for safety purposes only and is omitted from the drawings so that the internal components of the machine are clearly revealed.

Having thus described the invention, I claim:

1. Apparatus for propelling a ball in simulation of an underhanded fast pitch softball pitch, said apparatus comprising:

a frame;

an elongated ball propelling arm;

means rotatably mounting the arm on the frame for swinging through a 360° generally vertical path of travel about a generally horizontal axis;

first drive means operably coupled with the arm for swinging the latter at a relatively slow speed through a first segment of said path of travel;

second drive means operably coupled with said arm for swinging the latter at an increased speed through a second segment of said path of travel, said first and second segments being arranged about the axis so that the arm moves downwardly at least a portion of its movement through said second segments; and means carried by the arm and adapted to receive a ball to be propelled, said receiving means including a shroud defining an elongated, cylindrical cavity having a length greater than the diameter of the cavity, said shroud having an open outer end a closed end spaced radially of the arm inwardly from said open outer end, said shroud being carried by the arm in disposition to receive a ball therein and to carry the ball during the downward swinging of the arm and configured to release the ball to be propelled by centrifugal force rom the cavity during said second segment of said path of travel.

2. Apparatus as set forth in claim 1, wherein said arm is rigid and pivotally connected to said rotatable mounting means at one end of the arm, the shroud being secured to the arm proximal the opposite end of the arm.

3. Apparatus as set forth in claim 1, wherein said shroud is secured to the arm with the longitudinal axis of said elongated cavity disposed at an obtuse angle with respect to the longitudinal axis of said arm.

4. Apparatus as set forth in claim 3, wherein the arm includes a rigid plate having an elongated surface disposed in the path of swing of said arm, said shroud structure being configured and in disposition on the elongated surface so that a ball in the shroud cavity engages said surface, whereby force may be transmitted from the arm to the ball by said element surface.

5. Apparatus as set forth in claim 4, wherein said shroud comprises a cage of interconnected wire components to minimize the weight of said shroud.

6. Apparatus as set forth in claim 3, wherein the shroud is angled with respect to the arm so that the open end of the cavity is carried ahead of the end of the arm as the latter is moved along said path of travel.

7. Apparatus as set forth in claim 2, wherein said arm includes a pair of rigid brace members secured to the arm to augment the strength of the latter, said members being secured to the arm proximal the axis of rotation of said arm and extending longitudinally of the arm and wherein is included clamp means securing the brace members to the arm radially outwardly from said axis.

8. Apparatus as set forth in claim 1, wherein said first drive means includes a motor, and means operably coupling the motor with said arm, said coupling means including lost motion means permitting automatic disengagement of the arm from the motor means at a predetermined point on said path of travel of the arm to permit the swinging of the arm at said increased speed by said second drive means.

9. Apparatus as set forth in claim 8, wherein said second drive means includes spring means operably coupled with said arm so that the swinging of the arm by said motor through said first segment of the path of travel energizes the spring means for swinging the arm through said second segment of the path of travel when permitted by said lost motion means.

10. Apparatus as set forth in claim 9, wherein is included means operably associated with said arm for dampening the movement of the arm between the end of said second segment of said path of travel and prior to said first segment of the path of travel.

11. Apparatus as set forth in claim 1, including trajectory altering means carried by the arm proximal the ball receiving means and adapted to be engaged by a ball at said receiving means for imparting a spin to the ball as the latter is propelled by said arm.

12. Apparatus as set forth in claim 11, wherein said trajectory altering means includes at least one elongated, rigid finger element carried by the arm, means pivotally mounting the finger element for swinging toward and away from a ball at said receiving means, and means biasing said finger element toward engagement with the ball, whereby the friction resulting from said engagement causes the ball to spin when the ball is propelled from the receiving means by said arm.

13. Apparatus as set forth in claim 12, wherein said finger element is provided with a roughened surface in disposition for engaging said ball to enhance the spin inducing friction.

14. Apparatus as set forth in claim 13, wherein said roughened surface comprises a plurality of teeth carried by the finger element at said surface.

15. Apparatus as set forth in claim 12, wherein said trajectory altering means includes a pair of spaced apart, parallel, elongated, rigid finger elements, each finger element being biased toward engagement with the ball by said biasing means.

16. Apparatus as set forth in claim 15, wherein said biasing means including a spring.

17. Apparatus as set forth in claim 1, including means disposed adjacent the path of swinging movement of the arm and adapted to contain a supply of balls for automatically placing a single one of said supply at the ball receiving means each revolution of swing of the arm, said placing means operating to place said ball while the arm is swinging through said first segment of said path of travel.

18. A ball holding and throwing unit for a pitching machine for fast pitch softball, said unit comprising:

an elongated, rigid throwing element adapted to be carried by a swinging arm on a 360° path of travel lying in a generally vertically oriented plane and at different speeds during segments along said path with a relatively high speed of travel terminating at a zone of substantially deceleration proximal the lowermost position of said path to propel a ball by centrifugal force from the machine to simulate the underhand delivery in fast pitch softball, said element being disposed for imparting force from the swinging arm to said ball;

ball holding structure carried by the arm in disposition proximal the element for movement therewith on said path of travel, said structure being configured to define a cylindrical cavity of greater length than the diameter of the cavity and having an open outer end adapted to receive a ball in the cavity and to hold the latter in engagement with said element through said path of travel including downward movement of the element until the latter reaches said zone of substantial deceleration, the configuration of the element being such that the ball may move away from the element and out the open end of the cavity without restrictive holding by the structure when the latter is at said zone.

19. A unit as set forth in claim 18, wherein said structure comprises a cup-shaped shroud presenting an open ended ball receiving cavity, said shroud being oriented with the open end facing outwardly from the axis of swing of the arm.

20. A unit as set forth in claim 19, wherein the shroud defines an elongated, cylindrical cavity.

21. A unit as set forth in claim 20, wherein the shroud is constructed in the form of a cage comprising a plurality of spaced apart, interconnected wire members.

* * * * *